US010125319B2

(12) United States Patent
Koseoglu et al.

(10) Patent No.: US 10,125,319 B2
(45) Date of Patent: Nov. 13, 2018

(54) INTEGRATED PROCESS TO PRODUCE ASPHALT AND DESULFURIZED OIL

(75) Inventors: Omer Refa Koseoglu, Dhahran (SA); Abdennour Bourane, Ras Tanura (SA)

(73) Assignee: Saudi Arabian Oil Company, Dhahran (SA)

( * ) Notice: Subject to any disclaimer, the term of this patent is extended or adjusted under 35 U.S.C. 154(b) by 199 days.

(21) Appl. No.: 13/557,931

(22) Filed: Jul. 25, 2012

(65) Prior Publication Data

US 2013/0026075 A1 Jan. 31, 2013

Related U.S. Application Data

(60) Provisional application No. 61/513,621, filed on Jul. 31, 2011.

(51) Int. Cl.

| | |
|---|---|
| ***C10C 3/04*** | (2006.01) |
| ***C10G 27/04*** | (2006.01) |
| ***C10G 1/00*** | (2006.01) |

(52) U.S. Cl.

CPC ..... *C10G 1/00* (2013.01); *C10G 2300/202* (2013.01); *C10G 2300/4006* (2013.01); *C10G 2300/4012* (2013.01); *C10G 2300/44* (2013.01)

(58) Field of Classification Search

CPC combination set(s) only.
See application file for complete search history.

(56) References Cited

U.S. PATENT DOCUMENTS

| | | | | |
|---|---|---|---|---|
| 1,148,011 | A | | 7/1915 | Davies et al. |
| 2,327,247 | A | | 5/1939 | Carr et al. |
| 2,337,448 | A | | 1/1940 | Carr |
| 2,277,842 | A | | 3/1942 | Bray |
| 2,627,498 | A | * | 2/1953 | Fink ..... C10C 3/04 208/4 |
| 2,682,494 | A | * | 6/1954 | Weikart ..... 208/86 |
| 2,940,920 | A | | 6/1960 | Garwin |
| 2,970,956 | A | | 2/1961 | Shiah |
| 3,003,946 | A | | 10/1961 | Garwin |
| 3,236,883 | A | | 2/1966 | Losch |
| 3,258,419 | A | * | 6/1966 | Hanson ..... C10C 3/04 208/44 |
| 3,278,562 | A | | 10/1966 | Thigpen et al. |
| 3,380,912 | A | | 4/1968 | Paterson et al. |
| 3,719,589 | A | | 3/1973 | Herbstman et al. |
| 4,097,364 | A | | 6/1978 | Egan |
| 4,097,520 | A | | 6/1978 | Slattery |
| 4,113,661 | A | | 9/1978 | Tamm |
| 4,239,616 | A | | 12/1980 | Gearhart |
| 4,290,880 | A | | 9/1981 | Leonard |
| 4,305,814 | A | | 12/1981 | Leonard |
| 4,411,790 | A | | 10/1983 | Arod et al. |
| 4,430,203 | A | | 2/1984 | Cash |
| 4,482,453 | A | | 11/1984 | Coombs et al. |
| 4,502,944 | A | | 3/1985 | Nelson |
| 4,572,781 | A | | 2/1986 | Krasuk et al. |
| 4,601,816 | A | | 7/1986 | Rankel |
| 4,639,308 | A | | 1/1987 | Lee |
| 4,663,028 | A | | 5/1987 | Ditman |
| 4,747,936 | A | | 5/1988 | Penning |
| 4,757,042 | A | | 7/1988 | Threlkel |
| 4,810,367 | A | | 3/1989 | Chombart et al. |
| 4,816,140 | A | | 3/1989 | Trambouze et al. |
| 4,883,581 | A | | 11/1989 | Dickakian |
| 4,933,067 | A | * | 6/1990 | Rankel ..... 208/86 |
| 4,976,848 | A | | 12/1990 | Johnson |
| 4,990,243 | A | | 2/1991 | Winslow et al. |
| 5,059,304 | A | | 10/1991 | Field |
| 5,071,805 | A | | 12/1991 | Winslow et al. |
| 5,190,642 | A | | 3/1993 | Wilson et al. |
| 5,294,332 | A | | 3/1994 | Klotz |
| 5,324,417 | A | | 6/1994 | Harandi |
| 5,770,761 | A | | 6/1998 | Lin et al. |
| 6,160,193 | A | | 12/2000 | Gore |
| 6,171,478 | B1 | | 1/2001 | Cabrera et al. |
| 6,180,557 | B1 | | 1/2001 | Choudhary et al. |
| 6,274,785 | B1 | | 8/2001 | Gore |
| 6,277,271 | B1 | | 8/2001 | Kocal |
| 6,402,940 | B1 | | 6/2002 | Rappas |
| 6,406,616 | B1 | | 6/2002 | Rappas et al. |
| 6,596,914 | B2 | | 7/2003 | Gore et al. |
| 6,673,235 | B2 | | 1/2004 | Harris et al. |
| 7,820,031 | B2 | | 10/2010 | D'Alessandro et al. |
| 2002/0029997 | A1 | | 3/2002 | Rappas et al. |
| 2002/0035306 | A1 | | 3/2002 | Gore et al. |
| 2003/0094400 | A1 | | 5/2003 | Levy et al. |
| 2003/0136707 | A1 | | 7/2003 | Harris et al. |
| 2004/0178122 | A1 | | 9/2004 | Karas et al. |
| 2005/0183989 | A1 | | 8/2005 | Christensen |
| 2006/0027488 | A1 | | 2/2006 | Gauthier |
| 2006/0131214 | A1 | | 6/2006 | De Souza et al. |
| 2007/0138060 | A1 | | 6/2007 | Palmer et al. |
| 2007/0151901 | A1 | | 7/2007 | Sain et al. |

FOREIGN PATENT DOCUMENTS

| | | | |
|---|---|---|---|
| CA | 1140886 | A | 2/1983 |
| CA | 1159788 | A | 1/1984 |
| EP | 0097055 | A2 | 12/1983 |
| EP | 056324 | A1 | 10/1993 |
| EP | 1674158 | A1 | 6/2006 |
| GB | 2012809 | A | 8/1979 |
| JP | S54-102308 | A | 8/1979 |
| JP | S55-012200 | A | 1/1980 |
| JP | S57-164188 | A | 10/1982 |
| JP | S59-004686 | A | 1/1984 |

(Continued)

OTHER PUBLICATIONS

Buchanan, David et al. "The Effect of Air Oxidation on Sequential Solvent Extraction of the Argonne Premium Coal Samples," ACS Meeting 1987, pp. 293-300 (Sep. 9, 1987).

(Continued)

*Primary Examiner* — Randy Boyer
(74) *Attorney, Agent, or Firm* — Abelman, Frayne & Schwab

(57) ABSTRACT

An integrated process is provided to produce asphalt and desulfurized oil. Sulfur molecules contained in heavy petroleum fractions, including organosulfur molecules, and in certain embodiments organonitrogen molecules are oxidized. The polar oxidized sulfur compounds shift from the oil phase to the asphalt phase.

13 Claims, 1 Drawing Sheet

(56) References Cited

FOREIGN PATENT DOCUMENTS

| | | | |
|---|---|---|---|
| JP | S61-047793 | A | 3/1986 |
| JP | H05-286869 | A | 11/1993 |
| WO | 2003014266 | A1 | 2/2003 |
| WO | 2005012458 | A1 | 2/2005 |
| WO | 2006071793 | A1 | 7/2006 |
| WO | 2007103440 | A2 | 9/2007 |
| WO | 2007106943 | A1 | 9/2007 |
| WO | 2008048309 | A2 | 4/2008 |

OTHER PUBLICATIONS

Shiraishi, Yashurio, "Desulfurization of Vacuum Gas Oil Based on Chemical Oxidation Followed by Liquid-Liquid Extraction," Energy & Fuels 18 (1), pp. 37-40 (Nov. 21, 2003).
Furimsky, Edwards, "Chapter 2: Properties of Heavy Feeds," Studies in Surface Science and Catalysis; vol. 169, Catalysts for Upgrading Heavy Petroleum Feed, pp. 5-22 (2007).
PCT Application No. PCT/US2012/048145, International Seach Report and Written Opinion dated Oct. 31 2012 (13 Pages).
JP 2014-523969, Office Action dated Feb. 2, 2016, 5 pages.
JP 2014-523969, Office Action dated Dec. 13, 2016, 8 pages.

* cited by examiner

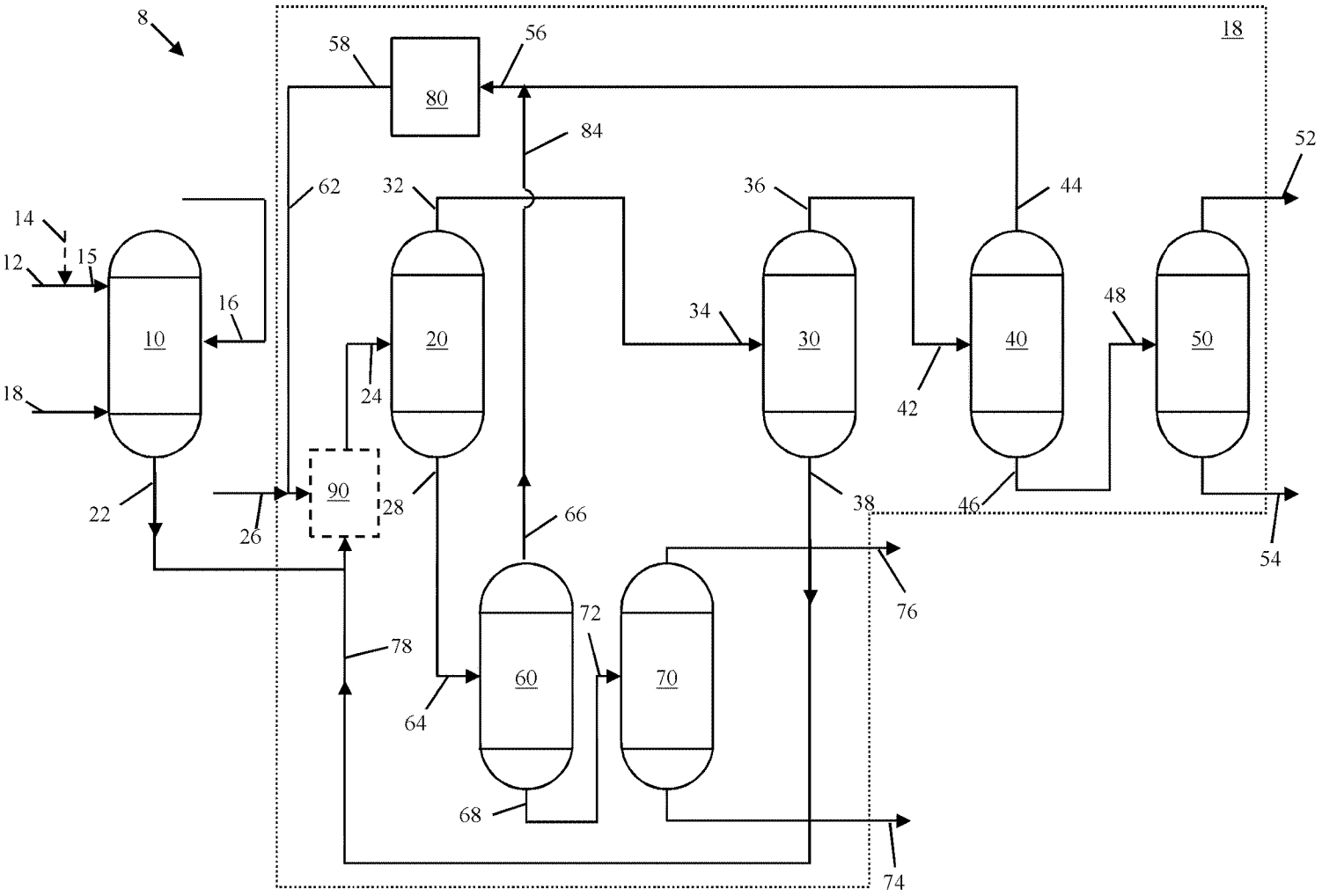
8
10
12
14
15
16
18
20
22
24
26
28
30
32
34
36
38
40
42
44
46
48
50
52
54
56
58
60
62
64
66
68
70
72
74
76
78
80
84
90

INTEGRATED PROCESS TO PRODUCE ASPHALT AND DESULFURIZED OIL

RELATED APPLICATIONS

This application claims the benefit of U.S. Provisional Patent Application No. 61/513,621 filed Jul. 31, 2011, the disclosure of which is hereby incorporated by reference in its entirety.

BACKGROUND OF THE INVENTION

Field of the Invention

This invention relates to processes and systems for production of asphalt and desulfurized and deasphalted oil.

Description of Related Art

Crude oils contain heteroatoms such as sulfur, nitrogen, nickel, vanadium and others in quantities that impact the refinery processing of the crude oils fractions. Light crude oils or condensates contain sulfur as low as 0.01 weight % (W %), in contrast, heavy crude oils contain as high as 5-6 W %. Similarly, the nitrogen content of crude oils is in the range 0.001-1.0 W %. The heteroatom contents of various Saudi Arabian crude oils are given in Table 1. As seen, the heteroatom content of the crude oils within the same family increases with decreasing API gravity on increasing heaviness. The heteroatom content of the crude oil fractions also increases with increasing boiling point (Table 2).

TABLE 1

| Property | ASL | AEL | AL | AM | AH |
|---|---|---|---|---|---|
| Gravity, ° | 51.4 | 39.5 | 33.0 | 31.1 | 27.6 |
| Sulfur, W % | 0.05 | 1.07 | 1.83 | 2.42 | 2.94 |
| Nitrogen, ppmw | 70 | 446 | 1064 | 1417 | 1651 |
| RCR, W % | 0.51 | 1.72 | 3.87 | 5.27 | 7.62 |
| Ni + V, ppmw | <0.1 | 2.9 | 21 | 34.0 | 67 |

ASL—Arab Super Light
AEL—Arab Extra Light
AL—Arab Light
AM—Arab Medium
AH—Arab Heavy

TABLE 2

| Fractions, ° C. | Sulfur W % | Nitrogen ppmw |
|---|---|---|
| $C_5$-90 | 0.01 | |
| 93-160 | 0.03 | |
| 160-204 | 0.06 | |
| 204-260 | 0.34 | |
| 260-315 | 1.11 | |
| 315-370 | 2.00 | 253 |
| 370-430 | 2.06 | 412 |
| 430-482 | 2.65 | 848 |
| 482-570 | 3.09 | 1337 |

Contaminants (poisonous compounds) such as sulfur, nitrogen, poly-nuclear aromatics in the crude oil fractions impact the downstream processes including hydrotreating, hydrocracking and fluid catalytic cracking (FCC). The contaminants are present in the crude oil fractions in varying structures and concentrations. These impurities must be removed during the refining to meet the environmental regulations for the final products (e.g., gasoline, diesel, fuel oil) or for the intermediate refining streams that need to be processed for further upgrading such as reforming isomerization.

In conventional refining schemes, crude oil is first distilled in an atmospheric column to separate sour gas and light hydrocarbons including methane, ethane, propane, butanes and hydrogen sulfide, naphtha (36-180° C.), kerosene (180-240° C.), gas oil (240-370° C.) and atmospheric residue bottoms which include hydrocarbons boiling above 370° C.

The atmospheric residue from the atmospheric distillation column is either used as fuel oil or sent to a vacuum distillation unit, depending on the configuration of the refinery. In configurations in which the bottoms are further distilled in a vacuum distillation column, products obtained include vacuum gas oil having hydrocarbons boiling in the range 370-520° C. and vacuum residue having hydrocarbons boiling above 520° C.

As the boiling point of the petroleum fractions increases, the quality of oil decreases and negatively impacts the downstream proceeding units. Table 3 and Table 4 provide quality of atmospheric (boiling above 370° C.) and vacuum residual (boiling above 520° C.) oils derived from various crude sources. It is clearly shown in these tables that the atmospheric or vacuum residues are highly contaminated with heteroatoms and have high carbon content and the quality deteriorates with increasing boiling point.

TABLE 3

| source | name | API Gravity, ° | Sulfur, W % | NI + V, ppmw | CCR, W % |
|---|---|---|---|---|---|
| Middle East | Arabian Light | 16.80 | 3.14 | 550.00 | 7.60 |
| Middle East | Arabian Heavy | 12.70 | 4.30 | 125.00 | 13.20 |
| South Asia | Mina | 26.40 | 0.15 | 16.00 | 4.20 |
| South Asia | Duri | 17.50 | 0.22 | 17.00 | 9.30 |
| China | Shengli | 18.70 | 1.23 | 19.00 | 8.60 |
| China | Taching | 25.10 | 0.13 | 4.00 | 4.00 |
| Latin America | Maya | 8.30 | 4.82 | 494.00 | 17.40 |
| Latin America | Isthmus | 13.90 | 2.96 | 53.00 | 8.20 |

TABLE 4

| source | name | API Gravity, ° | Sulfur, W % | Ni + V, ppmw | CCR, W % |
|---|---|---|---|---|---|
| Middle East | Arabian Light | 6.90 | 4.34 | 141.00 | 20.30 |
| Middle East | Arabian Heavy | 3.00 | 6.00 | 269.00 | 27.70 |
| South Asia | Mina | 17.30 | 0.19 | 44.00 | 10.40 |
| South Asia | Duri | 13.00 | 0.25 | 32.00 | 15.20 |
| China | Shengli | 11.70 | 1.66 | 28.00 | 16.40 |
| China | Taching | 18.70 | 0.18 | 9.00 | 9.50 |
| Latin America | Maya | −0.10 | 5.98 | 835.00 | 29.60 |
| Latin America | Isthmus | 4.00 | 4.09 | 143.00 | 21.10 |

Naphtha, kerosene and gas oil streams from crude oils or other natural sources such as shale oils, bitumens and tar sands, are treated to remove the contaminants mainly sulfur, whose quantity exceeds the specifications. Hydrotreating is the most common refining technology to remove these contaminants (poisonous compounds for other processes/catalysts). Vacuum gas oil is processed in a hydrocracking unit to produce gasoline and diesel or in an FCC unit to produce mainly gasoline, and LCO and HCO as by-products. The former of which is either used as a blending component in a diesel pool or fuel oil, while the latter is sent directly to the fuel oil pool. There are several processing options for the vacuum residue fraction, including hydroprocessing, coking, visbreaking, gasification and solvent deasphalting.

In additional configurations, vacuum residue can be treated in an asphalt unit to produce asphalt by air oxidation. Asphalt oxidation is a process in which air is bubbled through the feedstock or pitch in an oxidizer column vessel to oxidize sulfur-containing compounds. It is a non-catalytic process to shift the sulfur molecules from the oil phase to the asphalt phase.

As noted above, in some refining configurations, the vacuum residue can be processed in a solvent deasphalting unit to separate the solvent soluble (deasphalted oil) and insoluble oil (asphaltenes) fractions.

Solvent deasphalting is an asphalt separation process in which residue is separated by polarity, instead of by boiling point, as in the vacuum distillation process. The solvent deasphalting process produces a low contaminant deasphalted oil (DAO) rich in paraffinic type molecules. These fractions can then be further processed in conventional conversion units such as an FCC unit or hydrocracking unit. The solvent deasphalting process is usually carried out with paraffin $C_3$-$C_7$ solvents at or below critical conditions.

Further material regarding solvent deasphalting can be found in U.S. Pat. Nos. 4,816,140; 4,810,367; 4,747,936; 4,572,781; 4,502,944; 4,411,790; 4,239,616; 4,305,814; 4,290,880; 4,482,453 and 4,663,028, all of which are incorporated herein by reference.

While individual and discrete asphalt oxidation and solvent deasphalting processes are well developed and suitable for their intended purposes, there remains a need in the art for more economical and efficient processes for obtaining product from heavy fractions such as atmospheric residues.

SUMMARY OF THE INVENTION

The above objects and further advantages are provided by the system and process for producing deasphalted and desulfurized oil, and asphalt. An integrated process is provided to produce asphalt and desulfurized oil. Sulfur molecules contained in heavy petroleum fractions, including organosulfur molecules, and in certain embodiments organonitrogen molecules in heavy petroleum fractions are oxidized. The polar oxidized sulfur compounds shift from the oil phase to the asphalt phase. Advantageously, the present process and system can be integrated in existing solvent deasphalting units to remove impurities at comparatively lower cost.

While individual and discrete asphalt oxidation and solvent deasphalting processes are well developed, it has not previously been suggested to integrate the two processes to desulfurize atmospheric residual oil feedstock by oxidation and purify the oxidized feedstocks by solvent deasphalting process to produce desulfurized oil and asphalt products.

BRIEF DESCRIPTION OF THE DRAWINGS

The invention will be described in further detail below and with reference to the attached drawing where:

FIG. 1 is a process flow diagram of integrated asphalt oxidation and solvent deasphalting.

DETAILED DESCRIPTION OF THE INVENTION

An integrated process is provided to produce asphalt and desulfurized oil. In the process described herein, sulfur molecules, and in certain embodiments nitrogen molecules, that are present in heavy petroleum fractions (e.g., in atmospheric residue) are oxidized. The polar oxidized sulfur compounds and in certain embodiments oxidized nitrogen compounds which are generally insoluble in the solvent used in the process generally shift from the soluble oil phase to the insoluble asphalt phase. Advantageously, the present process and system can be integrated in existing refineries solvent deasphalting units to remove impurities at comparatively lower cost.

An atmospheric residue fraction, e.g., boiling 370° C. and above, is passed to an asphalt unit for air oxidation in the presence or absence of catalysts. The asphalt unit product is introduced to a solvent deasphalting unit to separate oil fractions containing a reduced content of organosulfur compounds, and in certain embodiments also a reduced content of organonitrogen compounds, from the asphalt product, as the oil phase is relatively lighter than the asphalt phase.

The process includes the steps of:

- Providing a hydrocarbon feedstock boiling in the range 36-1500° C., in certain embodiments above about 370° C. and in further embodiments above about 520° C., which contains impurities including sulfur, nitrogen compounds, nickel, vanadium, iron, molybdenum, typically from crude oil sources;
- Optionally adding the homogeneous catalysts to the feedstock. Homogeneous transition metal catalysts, active species of which are Mo(VI), W(VI), V(V), Ti(IV), possessing high Lewis acidity with weak oxidation potential are used as catalysts;
- Mixing a gaseous oxidant with the feedstock at the inlet of an asphalt oxidation unit. The gaseous oxidant is air or oxygen or nitrous oxide or ozone. The oxygen to oil ratio is in the range 1-50 V:V %, in certain embodiments 3-20 V:V % or equivalent for gaseous oxidants other than oxygen. The asphalt unit operates at a temperature of 100-300° C. and in certain embodiments 150-200° C. at the inlet and 150-400° C. and in certain embodiments 250-300° C. in the oxidation zone, and at a pressure level ranging from ambient to 60 bars and in certain embodiments from ambient to 30 bars;
- Mixing the asphalt reactor effluents in a vessel with a $C_3$ to $C_7$-paraffinic solvent, in certain embodiments a mixture of $C_4$-normal and iso-butane, at a temperature and a pressure that are below the solvent's critical pressure and temperature, to thereby disturb the equilibrium of the asphaltenes in maltenes solution and to flocculate the solid asphaltenes particles. The critical temperatures and pressures for the paraffinic solvents are given in Table 5, and other solvent properties are given in Table 6;
- Optionally using adsorbents in the solvent deasphalting stage to selectively further separate the nitrogen, sulfur and poly-aromatic compounds, for instance, as described in U.S. Pat. No. 7,566,634 which is incorporated by reference herein;
- Separating solid phase asphaltenes from the liquid phase in a first separator vessel and transferring the bottoms to asphalt pool and the upper liquid layer to a second separation vessel; and
- Separating the deasphalted oil in the second separation vessel and recovering the paraffinic solvent for recycling to the mixing vessel.

TABLE 5

| Carbon Number | Critical Temperature,° C. | Critical Pressure, bar |
|---|---|---|
| $C_3$ | 97 | 42.5 |
| $C_4$ | 152 | 38.0 |

TABLE 5-continued

| Carbon Number | Critical Temperature,° C. | Critical Pressure, bar |
|---|---|---|
| $C_5$ | 197 | 34.0 |
| $C_6$ | 235 | 30.0 |
| $C_7$ | 267 | 27.5 |

TABLE 6

| Name | Formula | MW g/g-mol | Boiling Point ° C. | Specific Gravity | Critical Temperature ° C. | Critical Pressure bar |
|---|---|---|---|---|---|---|
| propane | C3H8 | 44.1 | −42.1 | 0.508 | 96.8 | 42.5 |
| n-butane | C4H10 | 58.1 | −0.5 | 0.585 | 152.1 | 37.9 |
| i--butane | C4H10 | 58.1 | −11.7 | 0.563 | 135.0 | 36.5 |
| n-pentane | C5H12 | 72.2 | 36.1 | 0.631 | 196.7 | 33.8 |
| i--pentane | C5H12 | 72.2 | 27.9 | 0.625 | 187.3 | 33.8 |

Referring to FIG. 1, a process flow diagram of an integrated apparatus 8 for the production of asphalt and desulfurized oil is provided. Integrated apparatus 8 includes an oxidizing unit 10 (such as an oxidizer column vessel) and a solvent deasphalting unit 18 including a first separation vessel 20, a second separation vessel 30, a deasphalted/desulfurized oil separator 40, a solvent steam stripping vessel 50, an asphalt separation vessel 60, an asphalt stripper vessel 70, and a recycle solvent vessel 80.

Oxidizing unit 10 can be any suitable oxidation apparatus effective for converting organosulfur compounds and in certain embodiments organonitrogen compounds in a residual oil feedstock 12 into oxides thereof that are insoluble in the deasphalting unit solvent. In certain embodiments oxidizing unit 10 can be an oxidizer column vessel including an inlet 15 for receiving a residual oil feedstock 12 (downstream of one or more heat exchangers, not shown) and optionally catalyst 14, an inlet 16 for receiving blanketing steam, an gaseous oxidant inlet 18, and an oxidized residual oil outlet 22.

First separation vessel 20, e.g., a primary settler, includes an inlet 24 in fluid communication with outlet 22 of the oxidizer column vessel 10, an outlet 28 for discharging an asphalt phase, and an outlet 32 for discharging a deasphalted/desulfurized oil phase. A make-up solvent stream 26, a recycled solvent stream 62 and a second separation vessel bottoms stream 78 are also charged to the first separation vessel 20 via an optional mixing vessel 90.

Second separation vessel 30, e.g., a secondary settler, includes an inlet 34 in fluid communication with deasphalted/desulfurized oil 32 of the first settler vessel 20, an outlet 36 for discharging a deasphalted/desulfurized oil phase and an outlet 38 for discharging an asphalt phase.

Deasphalted/desulfurized oil separator 40 is typically a flash separator for solvent recovery and includes an inlet 42 in fluid communication with tops outlet 36 of the second separation vessel 30, an outlet 46 for discharging deasphalted/desulfurized oil separator bottoms, and an outlet 44 for discharging recycled solvent.

Solvent steam stripping vessel 50 includes an inlet 48 in fluid communication with outlet 46 of the deasphalted/desulfurized oil separator 40, an outlet 52 for discharging steam and excess solvent and an outlet 54 for discharging a deasphalted/desulfurized oil product stream suitable for further refinery processing.

Asphalt separation vessel 60 includes an inlet 64 in fluid communication with the asphalt phase outlet 28 of the first separation vessel 20, an outlet 68 for discharging asphalt separation vessel bottoms, and an outlet 66 for discharging recycled solvent to recycle solvent vessel 80.

Asphalt stripper vessel 70 includes an inlet 72 in fluid communication with bottoms outlet 68 of the asphalt separation vessel 60, an outlet 76 for discharging solvent and an outlet 74 for discharging asphalt product.

Recycle solvent vessel 80 includes an inlet 56 in fluid communication with tops outlet 44 of the deasphalted oil separator 40 and a conduit 84 which is in fluid communication with outlet 66 of asphalt separation vessel 60. Outlet 58 of recycle solvent vessel 80 is in fluid communication with conduit 62 for admixing with the feed.

A residual oil feedstock is introduced into inlet 12 of the oxidizer column vessel 10 after passage through one or more heat exchangers (not shown). In certain embodiments, a homogeneous catalyst can be introduced via conduit 14. Blanketing steam is continuously injected into the oxidizer column vessel 10 via inlet 16. Gaseous oxidant stream 18 after compression (for which the compressors are not shown) passes to a knockout drum (not shown) and is routed to distributors, e.g., above the bottom of the oxidizer column. Residual oil feedstock is oxidized and discharged via outlet 22.

The gaseous oxidant is air or oxygen or nitrous oxide or ozone. The oxygen to oil ratio is in the range 1-50 V:V %, preferably 3-20 V:V % or equivalent for other gaseous oxidants. The oxidizing unit operates at a temperature of 150-200° C. at the inlet and 250-300° C. in the oxidation zone, and at a pressure level ranging from ambient to 30 bars.

Asphalt oxidation serves to increase the molecular size of the asphaltene components by adding oxygen atoms to the heavy hydrocarbon molecules. This results in an asphalt product that is thicker and denser (60-70 mm penetration) than the vacuum column bottoms pitch feedstock (230-250 mm penetration). In the present process a feed such as an atmospheric residue is used to selectively oxidize the sulfur- and nitrogen-containing organic compounds to shift them to the asphalt phase. Accordingly, the primary objective of the integrated asphalt oxidation and solvent deasphalting unit is to produce desulfurized oil, and asphalt is produced as a by-product.

Oxidized residual oil feedstock from outlet 22 of the oxidizer column vessel 10 is mixed with make-up solvent 26 and recycled solvent 62, e.g., via one or more in-line mixers (not-shown) or an optional mixing vessel 90.

The asphalt oxidation reactor effluents are mixed with a $C_3$ to $C_7$-paraffinic solvent, in certain embodiments a mixture of $C_4$-normal and iso-butane, at a temperature and a pressure that are below the solvent's critical pressure and temperature, to thereby disturb the equilibrium of the asphaltenes in maltenes solution and to flocculate the solid asphaltenes particles. The critical temperatures and pressures for the paraffinic solvents are given in Table 5, and other solvent properties are given in Table 6. The admixing can occur in one or more mixing vessels and/or via one or more in-line mixers.

Optionally, adsorbents are used in the solvent deasphalting stage to selectively further separate the nitrogen, sulfur and poly-aromatic compounds, for instance, as described in U.S. Pat. No. 7,566,634 which is incorporated by reference herein.

The mixture is passed to inlet 24 of the first separation vessel 20, e.g., a primary settler of a solvent deasphalting unit, in which it is phase separated into a deasphalted/desulfurized oil phase discharged via outlet 32 and an asphalt phase discharged via outlet 28. The oxidized portion of the residual oil feedstock has a polarity that results in shifting to the asphalt phase due to its insoluble nature in the solvent. The pressure and temperature of the primary settler are at or below the critical properties of the solvent. The temperature of the primary settler is low in order to recover a majority of deasphalted/desulfurized oil from the oxidized residual oil charge. The solvent-soluble deasphalted/desulfurized oil phase which is collected from the primary settler, e.g., via a collector pipe, includes of a major proportion of solvent and deasphalted/desulfurized oil, and a minor proportion of asphalt. The solvent-insoluble asphalt phase which is recovered, e.g., via one or more asphalt collector pipes, includes a major proportion of asphalt, and a minor proportion of solvent, oil phase and oxidized organosulfur compounds (and in certain embodiments oxidized organonitrogen compounds).

Deasphalted/desulfurized oil is passed to inlet 34 of the second separation vessel 30, e.g., a secondary settler of a solvent deasphalting unit, to be separated into a deasphalted/desulfurized oil phase discharged via outlet 36 (e.g., a vertical collector pipe) and an asphalt phase via outlet 38 (e.g., one or more asphalt collector pipes). The remaining asphalt mixture containing oxidized organosulfur compounds (and in certain embodiments oxidized organonitrogen compounds) is rejected as asphalt phase in the secondary settler vessel 30 due to increased temperature relative to the operating temperature of the primary settler. The secondary settler is typically operated at temperatures at or approaching the critical temperature of the solvent, and enables formation of an asphalt phase at the bottom which contains relatively minor amount of solvent and deasphalted oil which is recycled back to the primary settler vessel 20. The deasphalted/desulfurized oil phase discharged via outlet 38 includes a major proportion of solvent and deasphalted/desulfurized oil and is recycled to the primary settler vessel 20 via conduit 78 for recovery of desulfurized oil.

The deasphalted/desulfurized oil phase from the second separation vessel outlet 36 is passed to inlet 42 of separator 40 to be separated into a deasphalted/desulfurized oil product stream 46 and solvent recycle stream 44. Recycled solvent via outlet 44 is passed to recycle solvent vessel 80 and returned to the primary settler vessel 20, e.g., via mixing vessel 90. The deasphalted/desulfurized oil separator 40 is configured and dimensioned to permit a rapid and efficient flash separation.

Deasphalted/desulfurized oil product stream 46 including a major proportion of deasphalted/desulfurized oil and a minor proportion of solvent and steam is conveyed to inlet 48 of vessel 50 for steam stripping of the solvent, e.g., with 150 psig of dry steam. The deasphalted/desulfurized oil is recovered via outlet 54, and a mixture of steam and excess solvent is discharged via outlet 52.

The primary settler asphalt phase via outlet 28 is passed to inlet 64 of the asphalt separation vessel 60 for flash separation into an asphalt phase discharged via outlet 68 and recycled solvent discharged via outlet 66. The asphalt phase 68 including a major proportion of asphalt and a minor proportion of solvent is conveyed to inlet 72 of the asphalt stripper vessel 70 for steam stripping of the solvent, e.g., with 150 psig of dry steam. Solvent is recovered via outlet 76 (which can be recycled, not shown) and an asphalt product containing oxidized organosulfur compounds (and in certain embodiments oxidized organonitrogen compounds) is recovered via outlet 74, which can be sent to an asphalt pool.

Recycled solvent from outlet 66 of the asphalt separation vessel 60 is passed to recycle solvent vessel 80 via conduit 84 along with recycled solvent 44 from second separation vessel 40. Recycled solvent is conveyed via outlet 58 as needed for mixing with the oxidized residual oil feedstock from outlet 22, e.g., in mixing vessel 90 and/or in one or more in-line mixers. One or more intermediate solvent drums can be incorporated as required.

In the primary settler 20, the deasphalted oil phase includes a majority of solvent and the deasphalted oil with a minor amount of asphalt discharged from the top of the primary settler (outlet 32). The asphalt phase which contains 40-50 liquid volume % solvent leaves the bottom of the vessel (outlet 28). In the secondary settler 30, the deasphalted oil phase from the primary settler 20 which contains some asphalt enters the vessel. The rejected asphalt from the secondary settler contains a relatively small amount of solvent and deasphalted oil. In the deasphalted oil separator 40, greater than 90 W % of the solvent charged to the settler enter the deasphalted oil separator where more than 95 wt % of that is recovered. Deasphalted oil from the deasphalted oil separator, which contains trace amount of solvent enters the deasphalted oil stripper 50. Essentially all solvent is removed from the deasphalted oil by steam stripping. The asphalt separator 60 permits flash separation of the asphalt and the solvent. The asphalt phase contains 40-50 volume % of solvent. Asphalt from the asphalt separator enters the asphalt stripper 70, where the residual solvent is removed from the asphalt by steam stripping. Approximately 95% of circulating solvent which is recovered in high pressure system and the balance of circulating solvent which is recovered in the low pressure system join together and enter the high pressure solvent drum 80.

The feedstock is generally atmospheric residue boiling above 370° C. In certain embodiments the feedstock can be whole crude oil with one or more separation steps upstream of the initial feed 12. A feedstock can be derived from one or more naturally occurring sources such as crude oils, bitumens, heavy oils, or shale oils, and/or bottoms from one or more refinery process units including hydrotreating, hydroprocessing, fluid catalytic cracking, coking, and visbreaking or coal liquefaction.

In one or more embodiments, a second feed can optionally be introduced with the mixture at inlet 24. In one or more embodiments, certain intermediate oil or asphalt streams can be recycled to the oxidizing unit 10.

Advantageously, by integrating asphalt oxidation and solvent deasphalting process, atmospheric residual oil feedstock is desulfurized with existing units to obtain desulfurized oil and asphalt at lower cost than conventional high-pressure desulfurization process. For instance, atmospheric residue can be desulfurized so that, in certain embodiments, 40 W % of desulfurized oil is recovered, with the remaining portion passing into the asphalt phase, which is also valuable product.

The method and system of the present invention have been described above and in the attached drawing; however, modifications will be apparent to those of ordinary skill in the art and the scope of protection for the invention is to be defined by the claims that follow.

The invention claimed is:

1. An integrated process for separating oil and asphalt in a feedstock comprising:

charging the feedstock and an effective quantity of homogeneous catalyst that contains transition metal catalyst active species selected from the group of Mo(VI) and W(VI) to an oxidizing unit along with an effective quantity of oxidant to produce an intermediate charge containing oxidized organosulfur compounds; and passing the intermediate charge to a solvent deasphalting unit along with an effective quantity of solvent to produce a deasphalted/desulfurized oil phase and an asphalt phase containing oxidized organosulfur compounds.

2. The process as in claim 1 in which the oxidizing unit is an asphalt oxidizer.

3. The process as in claim 1 wherein the intermediate charge contains oxidized organosulfur compounds and oxidized organonitrogen compounds.

4. The process as in claim 3 wherein the oxidized organosulfur compounds and oxidized organonitrogen compounds are insoluble in the solvent used in the solvent deasphalting unit and thereby shift to the asphalt phase.

5. The process as in claim 1 wherein the oxidizing unit is operated at an inlet temperature in the range of from 100-300° C.

6. The process as in claim 1 wherein the oxidizing unit is operated at an inlet temperature in the range of from 150-200° C.

7. The process as in claim 1 wherein the oxidizing unit is operated at a temperature in the range of from 150-400° C.

8. The process as in claim 1 wherein the oxidizing unit is operated at a temperature in the range of from 250-300° C.

9. The process as in claim 1 wherein the oxidizing unit is operated at a pressure in the range of from ambient to 60 bars.

10. The process as in claim 1 wherein the oxidizing unit is operated at a pressure in the range of from ambient to 30 bars.

11. The process as in claim 1, wherein the feedstock consists of atmospheric residue boiling above 370° C.

12. The process as in claim 1, wherein the transition metal catalyst active species is Mo(VI).

13. The process as in claim 1, wherein the transition metal catalyst active species is W(VI).

* * * * *